US005806537A

United States Patent [19]

Wittwer

[11] Patent Number: 5,806,537

[45] Date of Patent: Sep. 15, 1998

[54] ARTIFICIAL SUPPORT NAIL AND METHOD FOR APPLYING ARTIFICIAL SUPPORT NAIL

[76] Inventor: Juliet Wittwer, 5104 Lakeshore Dr., Waco, Tex. 76710

[21] Appl. No.: 911,764

[22] Filed: Aug. 15, 1997

[51] Int. Cl.[6] ..... A45D 29/00

[52] U.S. Cl. ..... 132/200; 132/73

[58] Field of Search ..... 132/200, 73, 285

[56] References Cited

U.S. PATENT DOCUMENTS

| | | | |
|---|---|---|---|
| 2,073,867 | 3/1937 | Feigenbaum | 132/73 |
| 4,007,748 | 2/1977 | Matranga et al. | 132/73 |
| 4,135,526 | 1/1979 | Matranga | 132/73 |
| 4,408,622 | 10/1983 | Meyerhoefer | 132/73 |
| 4,625,740 | 12/1986 | Roth | 132/73 |
| 4,751,935 | 6/1988 | Mast et al. | 132/73 |
| 4,767,648 | 8/1988 | Hokama et al. | 132/73 |
| 5,005,595 | 4/1991 | Aylott | 132/73 |
| 5,209,250 | 5/1993 | Taeckens | 132/73 |
| 5,413,123 | 5/1995 | Aylott | 132/73 |

*Primary Examiner*—Todd E. Manahan
*Attorney, Agent, or Firm*—Rudolf O. Siegesmund

[57] ABSTRACT

An apparatus and method for providing artificial support to the entire underneath surface of a natural fingernail so that the natural nail can grow without breaking.

3 Claims, 2 Drawing Sheets

ARTIFICIAL SUPPORT NAIL AND METHOD FOR APPLYING ARTIFICIAL SUPPORT NAIL

FIELD OF THE INVENTION

The present invention is directed, in general, to an apparatus and method for providing artificial support to the entire underneath surface of a natural fingernail so that the natural nail can grow without breaking.

BACKGROUND OF THE INVENTION

Many women have soft brittle nails and are unable to grow long shapely nails. There is a need for a product that women can apply themselves at home that will safely support and promote natural nail growth.

A problem with many existing artificial nails and sculptured nails designed to instantly lengthen and shape the nail is that because they are applied with adhesive to the top surface of the living nail, fungal and bacterial infections may occur.

Bacterial or fungal infections can occur in a number of ways. First, if the artificial nail separates from the living nail, dirt may enter the space between the artificial nail and the living nail. A separation between the living nail and the artificial nail can occur if the artificial nail is struck. If the separation is repaired by gluing the artificial nail back into place, bacteria or fungi may still grow in the space that was formed and spread to the living nail. In addition to accidents causing spaces for bacteria and fungi to grow, infections can also occur in the space which develops naturally between the artificial nail and the living nail through the natural growth of the living nail. In particular if the artificial nail is left in place for more than three months, the space between the artificial nail and the living nail can allow moisture to accumulate promoting the growth of bacteria and fungi. Another way in which infection can be caused is if in the process of placing the artificial nail on top of the living nail, too much of the cuticle is cut away or the cuticle is pushed back too far, then bacterial infections can occur.

Therefore, a need exists for an artificial nail and method of applying such an artificial nail that will allow the natural nail to grow without any of the problems attendant with traditional artificial nails.

The prior art teaches that the alternatives to an artificial nail glued to the top of the living nail have been variations on nail tips which are affixed to the end of the living nail. In U.S. Pat. No. 4,135,562,issued on Jan. 23, 1979, inventors Eve Matragna and Yosh Hukama identified the problems associated with the conventional practice of gluing artificial nails directly onto the upper exposed surface of the living nails and thereby damaging the upper exposed surface of the living nail through the promotion of fungus growth at the juncture of the living and artificial nails. Taking advantage of such quick drying glue as "Crazy Glue," the inventors created an artificial nail with an underside crescent shaped arc portion and a stop shoulder or step for abutting the living nail. The invention provided a tip attached to the living nail with little strength to resist upward pressure at the juncture. In U.S. Pat. No. 4,408,622, inventors Carl H. Meyerhoefer and Carl E. Meyerhoefer attempted to create a stronger artificial nail tip by creating an artificial nail tip having rearward concave edges forming a pocket into which the natural nail could fit. The "wedge splice" provided resistance to displacement in both upward and downward directions and left the upper portion of the living nail free of adhesive or bonded materials. In U.S. Pat. No. 5,005,595 issued Apr. 9, 1991, inventor David H Aylott, created an artificial nail with a handle portion attached and a support portion with a lip which would but up against the edge of the artificial nail. The Aylott artificial nail is attached by gluing the support portion of the artificial nail to the underside of the fingernail and then cutting away the handle portion. The nail support portion of the Aylott invention covers only a small portion of the undersurface of the nail. The treated nail grows with the support or repair portion permanently in position on the underside of the natural fingernail. The Aylott artificial nail is intended for the repair of split or broken fingernails. In U.S. Pat. No. 5,413,123 issued on May 5, 1995, David H. Aylott describes an artificial fingernail tip with a securement element consisting of a projection constructed to define a slot for receiving the living fingernail. Aylott identified the disadvantages of artificial nail tips as being susceptible to damage and to becoming detached because of the relatively small area of adhesive securement to the natural finger nail as opposed to the strength of the conventional artificial nails which derive their strength from being glued to the entire upper portion of the living nail.

Therefore, it can be seen that there exists a need for an artificial support nail and method of applying the artificial support nail so that the living nail can grow and yet not involve attachment of any artificial nail or glue to the upper living portion of the nail in order to avoid bacteria and fungal infection. A secondary need exists for an artificial support nail that will allow a damaged nail to be repaired while the natural nail grows. Such a support nail would not provide any cosmetic function to the natural nail.

The invention described herein addresses these needs and overcomes the problems and limitations of the prior art.

SUMMARY OF THE INVENTION

The artificial support nail attaches to the entire underneath surface of the natural nail using an adhesive for the purpose of giving support to and or repairing the natural nail. The support nail periodically falls off or is purposefully removed as the natural fingernail grows, and is replaced with a new longer support nail. This process can be repeated until the nail has grown naturally to the desired length. To maintain support and strength, the support nails should be replaced as needed.

The artificial support nail is attached to the entire underneath surface of the finger nail to provide support and strength while natural nail growth occurs. The artificial support nail has a rearward curved (convex) edge to butt up against the front of the finger when placed under the nail. The process includes the following steps:

(a) cleaning thoroughly the underside of the nail with a cotton swab soaked in rubbing alcohol;

(b) applying a quick drying nail adhesive to the upper surface of the artificial support nail;

(c) positioning the artificial support nail to the underneath surface of the nail butting up against the front edge of the finger;

(d) applying pressure for 30 to 60 seconds to the artificial support nail to ensure a secure bonding and even fit;

(e) separating the unused portion of the artificial support nail; and (f) shaping the bonded artificial support nail.

BRIEF DESCRIPTION OF THE DRAWINGS

The apparatus of the invention and method for applying the apparatus is further described and explained in relation to the following figures of the drawings wherein.

DESCRIPTION OF PREFERRED EMBODIMENTS

Figure 1A:
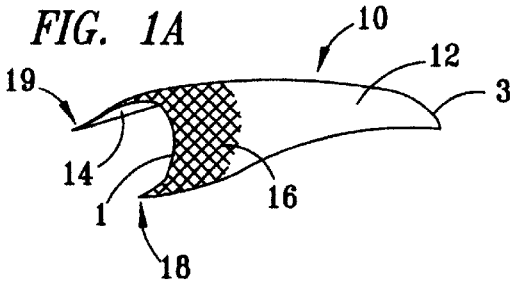
FIG. 1A is a side view of the top surface of the artificial support nail.
Figure 1B:
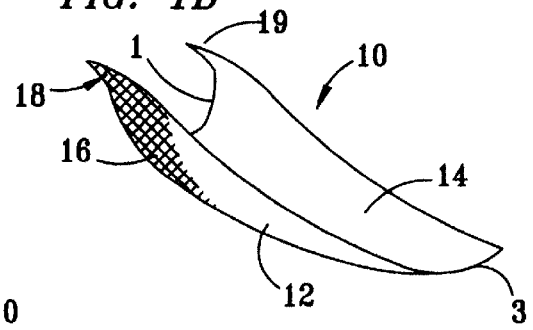
FIG. 1B is a side view of the bottom surface of the artificial support nail.
Figure 1C:
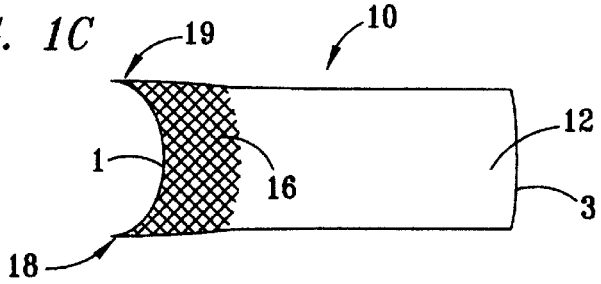
FIG. 1C is a top view of the artificial support nail.

In the discussion of the figures, the same numbers will be used to refer to the same or similar components throughout. According to the present invention, FIG. 1A depicts artificial support nail 10 with top surface 12 of artificial support nail 10. FIG. 1B depicts artificial support nail 10 with undersurface 14 of artificial support nail 10. FIG. 1C depicts top surface 12. Artificial support nail 10 has right prong 18 and left prong 19. Artificial support nail 10 has inside end 1 and outside end 3. Right prong 18 and left prong 19 are shown in all views of artificial nail 10; however, right prong 18 and left prong 19 are shown most clearly in FIG. 1B because of the angle of the view of artificial nail 10. FIG. 1A, FIG. 1B and FIG. 1C show roughened area 16. Artificial support nail 10 as shown in FIGS. 1A, 1B and 1C is made of molded plastic approximately 0.30 mm thick and 21 mm long. Artificial support nail 10 has a plurality of widths to fit the thumb and four fingers of most human hands. In the preferred embodiment of the invention, artificial support nail 10 will be manufactured in five sizes to fit the thumb and each of the other four fingers of the human hand. In the preferred embodiment of the invention right prong 18 and left prong 19 are molded into artificial nail 10 during manufacturing. An alternative embodiment is to use an artificial nail without prongs and to fashion right prong 18 and left prong 19 by filing the surface of the artificial nail with an Emory board to create artificial nail 10. Also in the preferred embodiment artificial nail 10 has roughened area 16 which is manufactured into the nail. Roughened area 16 can cover approximately one-quarter of the area of top surface 12. Alternatively it can cover any portion of top surface 12 up to and including the entire top surface 12. An alternative embodiment of roughened area 16 is that it is applied to top surface 12 using an emery board or other fine file when the roughened area 16 is not pre-manufactured.

Figure 2:
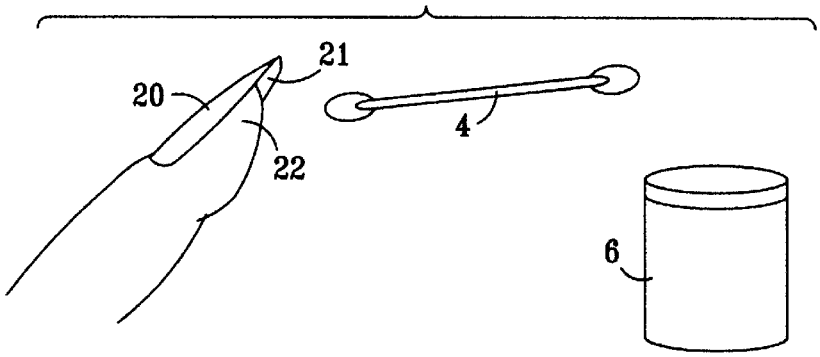
FIG. 2 shows the cotton swab to be used to apply alcohol to the underside the living nail.
Figure 3:
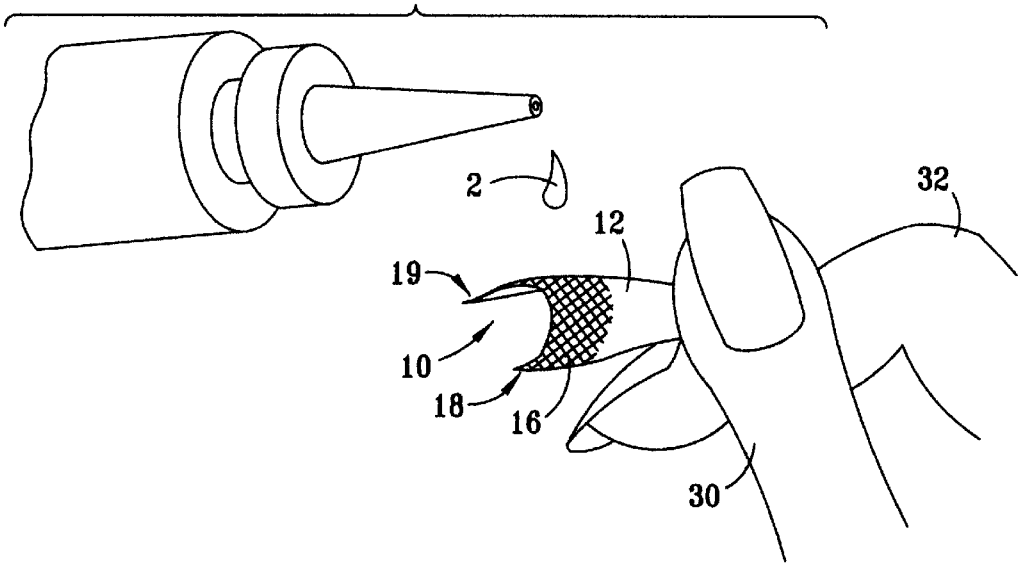
FIG. 3 shows the application of the adhesive to the top surface of the artificial support nail.

The first step is to prepare natural nail 20 by thoroughly cleaning natural nail 20 with cotton swab 4 soaked in isopropyl alcohol 6 as shown in FIG. 2. After cleaning natural nail 20 with isopropyl alcohol 6, natural nail 20 is allowed to dry in the air. FIG. 3 shows adhesive 2 being applied to the portion of top surface 12 of artificial support nail 10 that will fit underneath natural nail 20. The adhesive used may consist of ethylcyanoacrylate polymethyl methacrylate or other quick drying adhesives which are commercially available such as "origistick". Top surface 12 of artificial support nail 10 is intentionally left unpolished or rough during the manufacturing process and has a roughened area 16 to provide a good surface for the adhesive 2. Roughened area 16 can be added during manufacturing or can be done by use of an emery board prior to application. During manufacturing roughened area 16 can be extended to cover any area from one-quarter to all of top surface 12.

Figure 4:
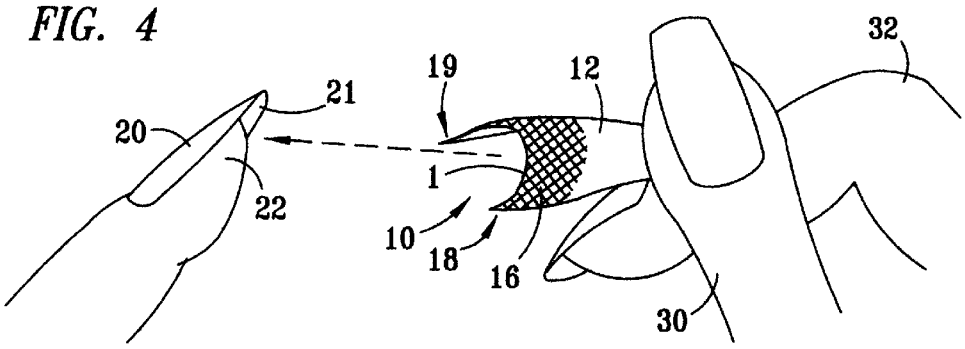
FIG. 4 demonstrates the placement of the prepared artificial support nail underneath the natural nail.
Figure 5:
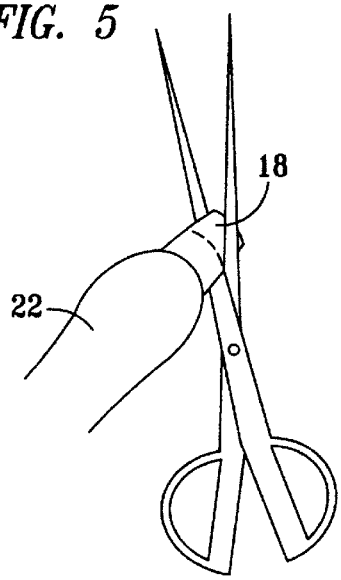
FIG. 5 shows the unused portion of the secured artificial support nail, viewed palm side up, being removed with a small pair of scissors.
Figure 6:
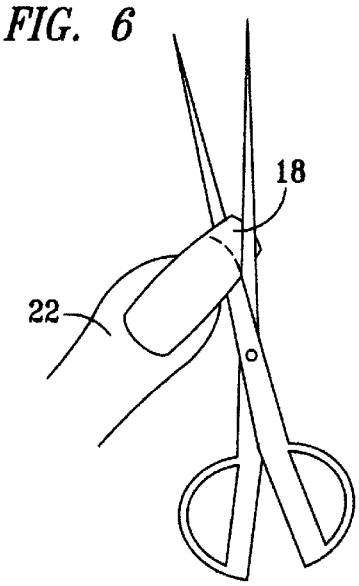
FIG. 6 shows the unused portion of the secured artificial support nail, viewed from the back of the hand, being removed with a small pair of scissors.
Figure 7:
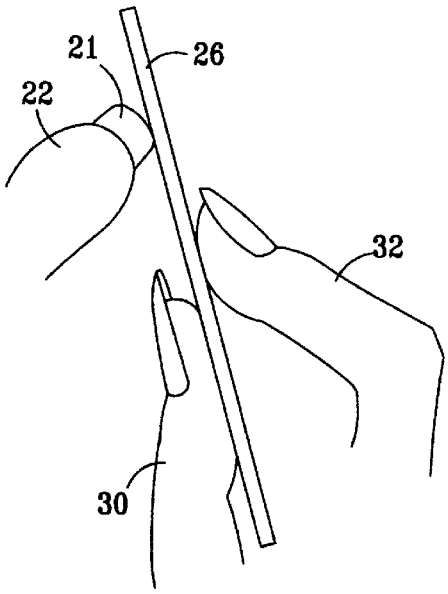
FIG. 7 shows the artificial support nail being shaped with an emery board.

In FIG. 4, artificial support nail 10 is positioned underneath natural nail 20 and placed so that inside end 1 of artificial nail 10 contacts the finger 22 by butting up against the finger 22 where finger 22 and natural nail 20 come together. Artificial support nail 10 is correctly positioned by manipulating it with the thumb 30 and forefinger 32 of the hand being used to perform the application. Right prong 18 and left prong 19 extend under natural nail 20 on the right side and left side of finger 22 to provide additional strength in all directions. Artificial support nail 10 is subjected to firm pressure from forefinger 32 and thumb 30 for a period of time from 30 to 60 seconds. The pressure is exerted to press artificial support nail 10 against underside 21 of natural nail 20. A slight pressure in the direction of finger 22 is exerted to fit right prong 18 and left prong 19 into position between finger 22 and natural nail 20. The combination of roughened area 16 on top surface 12 of artificial support nail 10, adhesive 2 and the firm pressure of forefinger 32 and thumb 30 result in a secure bond. Being careful to apply the nail adhesive 2 only to the portion of artificial support nail 10 fitting under natural nail 20 ensures that the adhesive 2 will not contact thumb 30 or forefinger 32. If adhesive 2 accidentally comes in contact with thumb 30 or forefinger 32 it can be removed by following the manufacturers directions. In FIG. 5, unused portion 18 of artificial support nail 10 extending past natural nail 20 is removed using scissors 34. In FIG. 5, the removal of unused portion 18 is shown from the view of the bottom of finger 22. In FIG. 6, the removal of unused portion 18 is shown from the top of finger 22. In FIG. 7, artificial support nail 10 and natural nail 20 are shaped using emery board 26.

Artificial support nail 10 always fits under the natural nail 20 when installed and the method of applying artificial support nail 10 provides that artificial support nail 10 will fit completely under the natural nail 20.

Artificial support nail 10 can be applied to natural nail 20 when natural nail 20 has only grown 1/16th of an inch beyond finger 22. In other words, only 1/16th of an inch of undersurface of natural nail 20 is necessary for application of artificial support nail 10. The ability to apply artificial support nail 10 to a natural nail 20 with only 1/16th of an inch of growth beyond finger 22 allows almost anyone to use artificial nail 10 because natural nail 20 will have very little likelihood of breaking at such a length.

Figure 8A:
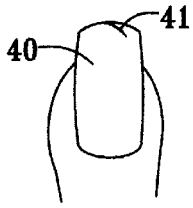
FIG. 8 shows types of damage nails that can be repaired using the artificial support nail.
Figure 8B:
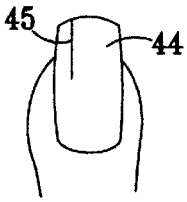
Figure 8C:
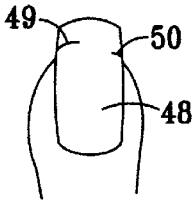

FIG. 8 depicts three common types of damaged nails. First damaged nail 40 has curving and descending crack 41 originating at the top of nail 40. Second damaged nail 44 has vertical crack 45 descending from the left side of the top of Nail 44. Third damaged nail 48 has horizontal crack 49 extending laterally across the surface of third damaged nail 48 from the left edge and horizontal crack 50 extending laterally across the surface of third damaged nail 48 from the right side of third damaged nail 48. All of these nails can be repaired using artificial support nail 10 and the method of applying artificial support nail 10 described herein.

The method described above can be repeated as many times as necessary. The average persons nails will grow out far enough in two to three weeks to require the application of a new artificial support nail. To apply a new artificial support nail, the old artificial support nail is removed by applying nail polish remover to the older artificial support nail until it dissolves or comes off of the natural nail. The application of nail polish remover to the old artificial support nail is accomplished by applying nail polish remover to a Q-tip such as cotton swab 4 and swabbing the old artificial support nail with the nail polish remover impregnated Q-tip or cotton swab. The swabbing is continued until the old artificial support nail dissolves or comes off of the natural nail. A new artificial support nail is then applied following all of the steps described above.

The artificial support nail 10 and method for applying artificial support nail 10 meet the needs identified above for an artificial support nail that can allow the natural nail to grow and yet not involve the attachment of any artificial nail, glue or adhesive to the upper living portion of the natural nail thus avoiding bacteria and fungal infections. Artificial support nail 10 and the method for applying artificial support nail 10 further meet the secondary need identified above for an artificial support nail that allows a damaged nail to be repaired while the natural nail grows.

Those skilled in the art should appreciate that the conception and the specific embodiment disclosed may be readily utilized as a basis for modifying or designing other structures for carrying out the same purposes of the present invention. Those skilled in the art should also realize that such equivalent constructions do not depart from the spirit and scope of the invention as set forth in the appended claims. Other alternatives and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

I claim:

1. A method of providing support and strength to a natural nail of a finger of a human hand by applying an artificial support nail to the underside of the natural nail comprising the steps of:

(a) cleaning the underside of the natural nail with a cotton swab soaked in rubbing alcohol;

(b) applying a nail adhesive to the top surface of the artificial support nail having an inside end and an outside end and a roughened area on the top surface of said artificial support nail;

(c) positioning the artificial support nail to the underside of the natural nail wherein the inside end of the artificial support nail contacts the front edge of the finger and the roughened area of the top surface of said artificial support nail contacts the underside of the natural nail;

(d) applying pressure to the artificial support nail and the natural nail to achieve a secure bonding and even fit;

(e) separating an unused portion of the artificial support nail wherein said unused portion comprises a portion of the artificial support nail extending beyond the natural nail of the finger; and (f) shaping the artificial support nail;

wherein the artificial support nail comprises an inside end and an outside end and an upper surface and a lower surface and a left prong and a right prong extending outward from the inside end of said artificial support nail;

wherein said left prong and said right prong are shared to fit under the natural nail on the right and left side of the finger and between the underside of the natural nail and the finger; and wherein the inside end of said artificial support nail is shaped to contact the finger where the finger and the natural nail come together; and wherein said positioning comprises manipulating the artificial support nail so that pressure in the direction of the finger is exerted to fit the riaht prong and the left prong into position between the finger and the natural nail and between the underside of the natural nail and the finger.

2. The method of claim 1 further comprising the steps of:

(a) applying nail polish remover to the artificial support nail until it dissolves or separates from the natural nail; and (b) repeating the steps of claim 1;

wherein steps (a) and (b) are performed when the natural nail of the finder of the human hand has grown for a period of approximately two to three weeks so that a new artificial support nail can be positioned in order to support the growth of the natural nail.

3. An apparatus for providing support and strength to a natural nail of a finger of a human hand comprising:

(a) an artificial support nail having an inside end and an outside end and a top surface and an undersurface wherein the top surface and the undersurface of said artificial support nail are unpolished;

(b) a left prong and a right prong extending outward from the inside end of said artificial support nail;

wherein said left prong and said right prong are shaped to fit under the natural nail on the right and left side of the finger and between the underside of the natural nail and the finger; and wherein the inside end of said artificial support nail is shaped to contact the finger where the finger and the natural nail come together;

wherein the top surface of said artificial support nail further comprises a roughened area wherein said roughened area of said top surface extends from the inside end of the top surface so that said roughened area covers at least one quarter of the top surface; and wherein said roughened area facilitates the use of adhesive to form a secure bond between the artificial support nail and the underside of the natural nail.

* * * * *